United States Patent [19]

Welch

[11] Patent Number: 4,647,048

[45] Date of Patent: Mar. 3, 1987

[54] GOLF STANCE DEVICE

[76] Inventor: Alan E. Welch, 1885 Old Homestead Dr., Rochester, Mich. 48063

[21] Appl. No.: 765,201

[22] Filed: Aug. 13, 1985

[51] Int. Cl.[4] ..... A63B 69/36

[52] U.S. Cl. ..... 273/187 R; 273/188 A

[58] Field of Search ..... 273/187 R, 187 A, 187 B, 273/183 A

[56] References Cited

U.S. PATENT DOCUMENTS

| | | | |
|---|---|---|---|
| 2,189,613 | 2/1940 | Paulsen | 273/187 R |
| 3,041,075 | 6/1962 | Taylor | 273/187 R |
| 3,244,421 | 4/1966 | Hanna | 273/187 R |
| 3,658,344 | 4/1972 | Kimble | 273/187 R |
| 4,032,157 | 6/1977 | Carpenter | 273/183 E |

FOREIGN PATENT DOCUMENTS

| | | | |
|---|---|---|---|
| 17666 | 10/1916 | United Kingdom | 273/187 R |

*Primary Examiner*—George J. Marlo

*Attorney, Agent, or Firm*—Gifford, Groh, VanOphem, Sheridan, Sprinkle & Dolgorukov

[57] ABSTRACT

A device for setting a player's stance for the game of golf having an elongated base with two elongated arms extending outwardly from one end of the base. Each arm is pivotally attached to the base and is constructed from two telescoping sections so that the length of each arm is adjustable. A pair of stops are adjustably attached to the base and limit the pivotal movement of the arms while a spring urges the arms against the stops. A foot guide is secured to the free end of each arm and the foot guides are adapted to receive the player's feet. With the player's feet positioned in the foot guides and the other end of the base positioned adjacent a golf ball, the player's stance is set for the golf shot.

6 Claims, 6 Drawing Figures

GOLF STANCE DEVICE

BACKGROUND OF THE INVENTION

I. Field of the Invention

The present invention relates generally to the game of golf and, more particularly, to a device for setting a player's stance.

II. Description of the Prior Art

In the game of golf the player stance, i.e. the position of the player's feet with respect to the golf ball, is of the utmost importance in order to obtain a good golf shot. If the player's feet are improperly positioned when he or she addresses the ball, hooks, slices and other poor shots frequently result.

The proper stance for a player varies from one player and to the next. Furthermore, the proper stance also varies depending on the type of shot to be made. For example, a proper stance for a tee shot for a player will be different than the proper stance for a nine-iron shot even for the same player.

Most players determine their proper golf stance for the various different golf shots only through practice and experience. However, even experienced golfers adopt improper golf stances after periods of golf inactivity. When this occurs, it often takes the golfer several rounds before he or she regains their proper golf stance.

SUMMARY OF THE PRESENT INVENTION

The present invention provides a device for setting the stance of a golfer which overcomes all of the above-mentioned problems.

In brief, the golf stance device of the present invention comprises an elongated base having a first end which is adapted to the position adjacent a golf ball to be struck. A pair of elongated arms are pivotally mounted to the other end of the base and each arm includes one or more telescoping sections so that the length of each is adjustable. A U-shaped foot guide is then secured to the outer or free ends of the arms and each foot guide is dimensioned to receive one foot of the golfer.

In order to use the golf stance device of the present invention, the golfer determines his or her proper stance for a particular golf shot in any conventional fashion, such as on a driving range. Once the proper golf stance has been determined, the golfer adjusts the length and pivotal position of the arms so that one end of the base is positioned adjacent the golf ball while the golfer's feet are positioned within the foot guides at the outer or free ends of the arms. Preferably, means are included to lock the arms in their adjusted positions.

Thereafter, when the golfer wishes to set his stance, for example following a period of golf inactivity, the arms are moved to their adjusted position, the free end of the base is positioned adjacent the golf ball and the golfer's feet positioned within the foot guides. In doing so, the golfer's stance is set to the proper position for the golf shot.

BRIEF DESCRIPTION OF THE DRAWING

A better understanding of the present invention will be had upon reference to the following detailed description when read in conjunction with the accompanying drawing, wherein like reference characters refer to like parts throughout several views and in which.

DETAILED DESCRIPTION OF A PREFERRED EMBODIMENT OF THE PRESENT INVENTION

Figure 1:
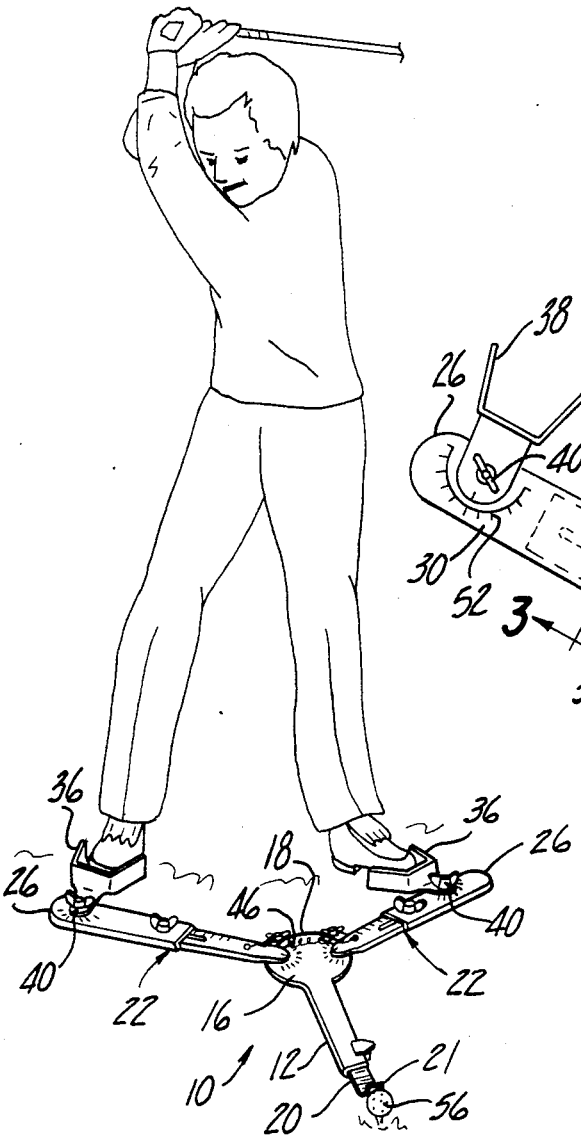
FIG. 1 is an elevational view illustrating a preferred embodiment of the present invention.
Figure 2:
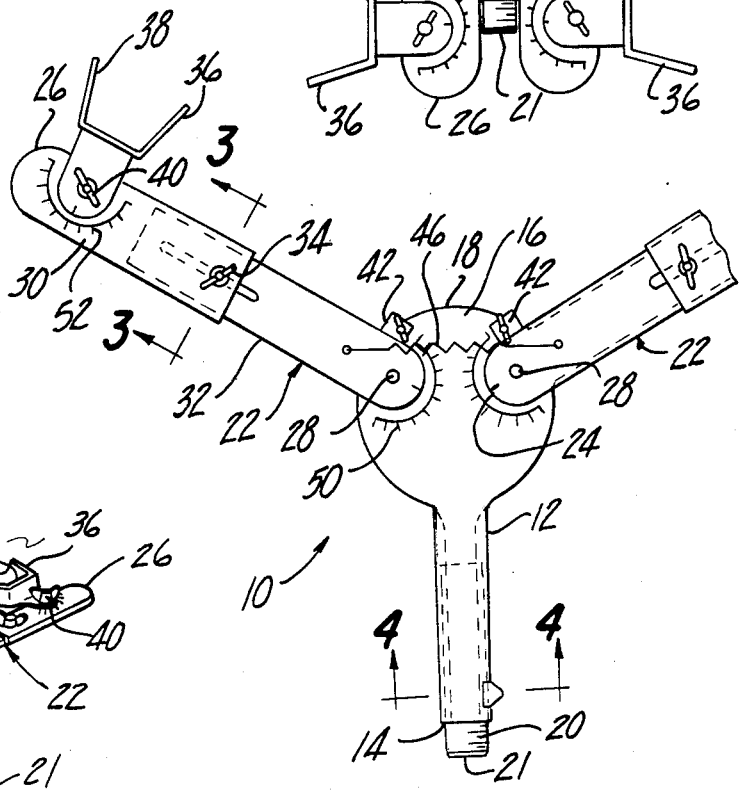
FIG. 2 is a fragmentary top view illustrating the preferred embodiment of the present invention.
Figure 4:
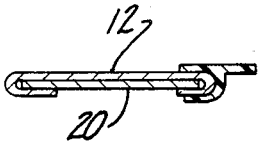
FIG. 4 is a sectional view taken substantially along line 4—4 in FIG. 2.

With reference first to FIGS. 1 and 2, a preferred embodiment of the golf stance device 10 of the present invention is thereshown and comprises an elongated and generally flat base 12 having a first end 14 and a circular plate 16 at its other end 18. As best shown in FIGS. 2 and 4, the base 12 includes a slide 20 slidably received within the end 14 of the base 12 so that the effective longitudinal length of the base 12 can be varied by shifting the position of the slide 20. An indicia scale on the slide 20 (FIG. 2) allows the slide 20 to be set or reset to any desired position for a reason to be subsequently described.

Referring again to FIGS. 1 and 2, the golf stance device 10 further comprises two elongated and substantially identical arms 22, each having an inner end 24 and an outer 26. The inner ends 24 of the arms 22 are pivotally mounted to opposite sides of the circular base plate 16 by pivot pins 28 which allow the arms 22 to pivot from a first position, illustrated in FIG. 2, and to a second position, illustrated in FIG. 6, in which the arms 22 are generally parallel to and adjacent the base 12.

Figure 3:
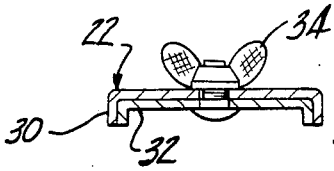
FIG. 3 is a sectional view taken substantially along line 3—3 in FIG. 2.

As best shown in FIGS. 2 and 3, each arm 22 is preferably constructed from two telescoping sections 30 and 32 so that the overall length of the arms 22 can be adjustably varied. A wing nut assembly 34 or the like is provided for locking the sections 30 and 32 together at their longitudinally adjusted position.

Referring again to FIGS. 1 and 2, a foot guide 36 is secured to the free or outer end 26 of each arm 22. Each foot guide 36 comprises a U-shaped member 38 which is dimensioned to receive a front part of the golfer's foot. In addition, each foot guide 36 is preferably pivotably secured to its respective arm 22 by a wing nut or locking assembly 40 so that the pivotal position of the foot guide 36 can be adjusted and then locked into its adjusted position by the wing nut assembly 40.

Figure 5:
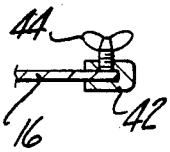
FIG. 5 is a fragmentary side sectional view taken at the upper central portion of FIG. 2.

With reference now to FIGS. 2 and 5, a pair of stops 42 are adjustably secured to the base circular plate 16 in between the arms 22. The position of the stops 42 can be adjusted to any desired position along the plate 16 and then locked at their adjusted position by any conventional fastener 44. These stops 42, furthermore, are dimensioned to abut the side of the arms 22 when the arms 22 are in their first pivotal position illustrated in FIG. 2. Consequently, the first pivotal position of the arms 22 can be adjusted by adjusting the position of the stops 42 along the base plate 16.

Figure 6:
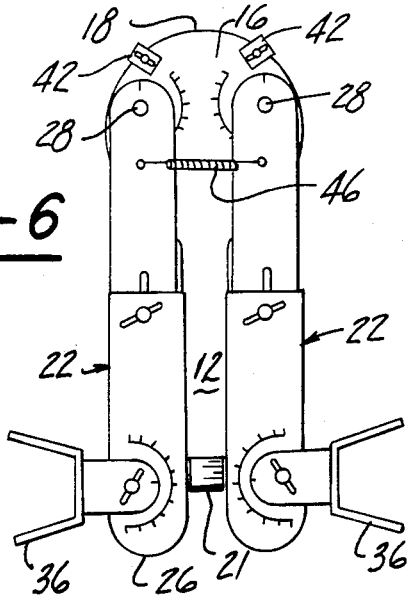
FIG. 6 is a view similar to FIG. 2 but illustrating the golf stance device in a collapsed condition.

With reference now to FIGS. 2 and 6, a spring 46 under tension is attached between the arms 22 at a position longitudinally spaced from the pivot pins 28. This spring 46 resiliently maintains the arms 22 into abutment against the stops 42 and thus at their first position. Conversely, when the arms 22 are pivoted to their collapsed position shown in FIG. 6, the spring 46 resiliently urges the arms 22 together and maintains the arms 22 in their collapsed position for storage or transportation.

As is shown in FIG. 2, an indicia scale 50 is preferably provided between each arm 22 and the base plate 16 while a similar indicia scale 52 is provided between the foot guides 36 and their arms 22. The indicia scales 50 and 52 thus allow the pivotal position of the foot guides 36 and arms 22 to be rapidly and easily set to predetermined positions.

With reference now to FIG. 2, in operation a golfer determines his or her proper golf stance for a particular golf shot in any conventional fashion, such as on a driving range. Once the golf stance has been determined, the slide 20 is adjusted so that its free end 21 is positioned adjacent the golf hall 56 which is to be struck. The length of the arms 22 as well as the pivotal position of the arms 22 and pivotal position of the foot guides 36 are then adjusted by the golfer so that the golfer's feet are positioned within the foot guides 36 as shown in FIG. 1. When the device 10 is properly adjusted to conform to the player's stance, the wing nut assemblies 34 and 40 and fastener 44 (FIG. 5) are tightened thus locking the arms 22, foot guides 36, and stops 42 in their adjusted position.

Thereafter, when the golfer desires to set his or her stance for the golf shot, the player positions the device 10 on the ground as shown in FIG. 1 so that the end 21 of the slide 20 is adjacent the ball 56 and the player's feet are positioned within the foot guides 36. In doing so, the proper stance for the golf shot is established.

From the foregoing, it can be seen that the present invention provides a simple, inexpensive and yet totally effective means for setting the stance of a golfer for a golf shot. Furthermore, the arms 22, slide 20 and foot guides 36 can be adjusted, if desired, for different types of golf shots.

A still further advantage of the present invention is that the arms 22 can be compactly collapsed to the position shown in FIG. 6 for easy storage and/or transportation of the golf device.

Having described my invention, however, many modifications thereto will become apparent to those skilled in the art to which it pertains without deviation from the spirit of the invention as defined by the scope of the appended claims.

I claim:

1. A device for setting a player's stance in the game of golf comprising:
   - an elongated base having a first end and a second end, said first end of said base adapted to be positioned adjacent a ball to be struck,
   - a pair of elongated arms,
   - a pair of stops and means for adjustably securing said stops to the second end of said base,
   - means for pivotally connecting one end of each arm to the second end of said base so that said arms are pivotal between a first position in which said arms abut against said stops and a second position in which said arms are substantially parallel to each other and parallel to said base,
   - means for resiliently urging said arms to either said first position or said second position,
   - a pair of foot guides,
   - means for attaching one foot guide to the other end of each arm, and
   - means for adjusting the longitudinal length of each arm.

2. The invention as defined in claim 1 wherein each arm comprises a first longitudinal segment and a second longitudinal segment and wherein said adjusting means comprises means for telescopically connecting said first and second segments together.

3. The invention as defined in claim 2 and comprising means for locking said first and second segments together at an adjusted position.

4. The invention as defined in claim 1 and comprising a slide longitudinally slidably mounted at said first end of said base.

5. The invention as defined in claim 1 wherein each foot guide comprises a U-shaped member adjusted to receive a forward portion of a foot and comprising means for pivotally securing said foot guides to said arms.

6. The invention as defined in claim 5 and comprising means for locking each foot guide to its respective arm at an adjusted pivotal position.

* * * * *